US006153566A

United States Patent [19]

Yonekura et al.

[11] Patent Number: 6,153,566

[45] Date of Patent: Nov. 28, 2000

[54] BACTERIOSTATIC COMPOSITIONS AND USE IN METAL WORKING FLUIDS

[75] Inventors: Aki Yonekura, Kyoto; Toshifumi Hatanaka; Tetsushi Kawamura, both of Toyko, all of Japan; Henri-Jean Caupin, Versailles, France

[73] Assignee: Elf Atochem S.A., Paris la Defense Cedex, France

[21] Appl. No.: 08/945,730

[22] PCT Filed: Apr. 4, 1996

[86] PCT No.: PCT/EP96/01520

§ 371 Date: Jun. 3, 1998

§ 102(e) Date: Jun. 3, 1998

[87] PCT Pub. No.: WO96/35767

PCT Pub. Date: Nov. 14, 1996

[30] Foreign Application Priority Data

May 10, 1995 [JP] Japan ..... 7-111705

[51] Int. Cl.[7] ..... C10M 129/26; C10M 133/16

[52] U.S. Cl. ..... 508/516; 508/527; 508/530; 508/551

[58] Field of Search ..... 508/516, 519, 508/527, 530, 551, 555

[56] References Cited

U.S. PATENT DOCUMENTS

| | | | |
|---|---|---|---|
| 3,375,164 | 3/1968 | Mulinos | 167/58 |
| 3,769,214 | 10/1973 | Davis | 508/554 |
| 4,759,861 | 7/1988 | Ogura et al. | 508/530 |
| 5,171,903 | 12/1992 | Koyama et al. | 585/3 |
| 5,441,979 | 8/1995 | Oppong | 514/515 |
| 5,670,160 | 9/1997 | Eggensperger et al. | 424/405 |

*Primary Examiner*—Margaret Medley
*Assistant Examiner*—Cephia D. Toomer
*Attorney, Agent, or Firm*—Millen, White, Zelano & Branigan, P.C.

[57] ABSTRACT

The present invention concerns bacteriostatic compositions comprising a bacteriostatic agent selected from the group comprising amides and amine salts of normal heptanoic acid and amides, amine salts and alkyleneoxide addition compounds of undecylenic acid. It also concerns the use of said compositions in the field of metal working fluids.

11 Claims, No Drawings

BACTERIOSTATIC COMPOSITIONS AND USE IN METAL WORKING FLUIDS

BACKGROUND OF THE INVENTION

This invention relates to basteriostatic compositions used in metal working such as cutting and grinding of metals.

It is known that aqueous metal working liquid contains, as an effective component, organic compound and hence is deteriorated or decomposed by bateria or molds. In fact, microorganismes which enter into a working liquid utilize organic oil compounds in the working liquid as a nutritive substance and multiply gradually, resulting in the putrefaction of the oil components. Therefore, an antiseptic agent is added to the working liquid to prevent it from such putrefaction. It is a recent trend to develop anti-microorganismes type metal working liquids as well as to improve the performance of the working liquid.

Examples of the antiseptic agent are organic nitrogen-containing compounds such as triazines, thiazines, isothiazolines such as Keson (trade name) and pyrizines. Phenol type compounds and boron type compounds are also envisaged.

Generally, an aqueous working liquid or coolant is poured onto a working point and is recycled. The aqueous working liquid, however, deteriorates gradually, resulting in a foul odor, the bacteria of pH which causes corrosion, as well as in a decrease of lubrication efficiency. The most serious problem is clogging of piping caused by generation of slime (mold).

The known antiseptic agents mentioned above are useful to solve the problems. However, they are not perfect insofar as they are deficient in at least one of areas of corrosion, decomposition, odor foam and waste liquid. Therefore, there is a demand to develop a bioactive type aqueous working liquid which can solve the problems, is harmful to the human body and the environment and which is easy to manage.

SUMMARY OF THE INVENTION

An object of the present invention is to provide a bacteriostatic composition.

Another object of the present invention is to use said composition so as to provide a metal working composition and method having an improved bacteriostatic property.

In order to solve the problems, the present inventors found that additives selected from the group comprising amides and amine salts of heptanoic acid or amides, amine salts and alkylene/oxide addition compounds of undecylenic acid possess excellent bacteriostatic property in metal working liquids.

Thus, the present invention provides bacteriostatic compositions for metal working containing at least one compound as mentioned above, said compositions being used in aqueous or emulsion type metal working liquids.

The additive according to the present invention is selected from the group comprising amides and amine salts of heptanoic acid and amides, amine salts and alkyleneoxide addition compounds of undecylenic acid.

Derivatives of heptanoic acid are selected among:

(a) amides of formula:

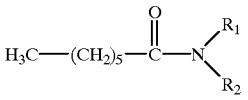

in which $R_1$ and $R_2$, identical or different, represent H, a $C_{1-20}$ alkyl group or a $C_{1-20}$ alkyl group having a hydrophilic group, and (b) amine salts of formula:

$$H_3C—(CH_2)_5—COO^-R_3^+$$

in which $R_3$ represents a primary or secondary alkyl or alkanol amine salt.

Derivatives of undecylenic acid are selected among:

(a) amides of formula:

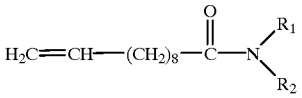

in which $R_1$ and $R_2$, identical or different, represent H, a $C_{1-20}$ alkyl group or a $C_{1-20}$ alkyl group having hydrophilic group, (b) amine salts of formula:

$$H_2C=CH—(CH_2)_8—COO^{-R}{}_3^+$$

in which $R_3$ represents a primary or secondary alkyl or alkanol amine salt, and (c) alkylene/oxide addition compouds of formula:

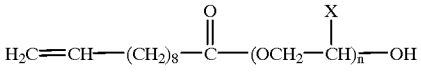

in which X represents H or a methyl group and n represents an integer of 1 to 50.

Amides and amine salts of heptanoic or undecylenic acid can be easily prepared by a reaction between the corresponding acid and an organic nitrogen-containing compound such as monoalkylamine and dialkylamine of carbon number of 1 to 20, cyclohexylamine, dicyclohexyl amine, or those whose alkyl has at least one hydrophilic group such as monoethanol amine or diethanol amine.

Alkylene/oxide addition compounds of undecylenic acid can be prepared by a reaction between undecylenic acid and the corresponding alkylene/oxide compound.

When more than two compounds are selected and combined in the group comprising amides and amine salts of heptanoic acid and amides, amine salts and alkylene/oxide addition compounds of undecylenic acid, the ratio of these derivatives of heptanoic acid and undecylenic acid is not specially limited but can be in the range of 9:1 to 1:9, preferably 8:2 to 2:8.

The content of amides and amine salts of heptanoic acid or amides, amine salts and alkylene/oxide addition compounds of undecylenic acid in a working liquid is not specially limited but can be in a range of 0.01 to 40%, preferably 0.1 to 20%, more preferably 0.5 to 10% by weight of the total amount of the composition.

If the content of amides and amine salts of heptanoic acid or amides, amine salts and alkyleneoxide addition compounds of undecylenic acid is not sufficient, satisfactory bacteriostatic effect in metal working liquid cannot, be expected. On the contrary, an excess amount thereof does not improve bacteriostatic property and is not economical.

The composition according to the present invention can also contain other optional additives such as surfactants, anti-corrosion agents and extreme pressure additives in addition to the bacteriostatic additive. The proportion of these additives is not specially limited but is less than 10%, preferably less than 5% by weight of the total amount of the composition.

The amide or amine salt of heptoic acid or amide, amine salt or alkyleneoxide addition compound of undecylenic acid is mixed with mineral oil or machine oil to prepare an aqueous or an emulsion type metal working liquid.

The present invention provides a less odoriferous bacteriostatic agent for metal working liquid and a metal working liquid having bacteriostatic property. Since the bacteriostatic additive of the present invention is derived from natural product, the metal working liquid obtained therefrom does not irritate skin and is mild for human beings and the environment.

The present invention is illustrated by Examples but is not limited thereto.

Tests of Bacteriostatic Property and Odor 2 parts by weight of bacteriostatic agent are added to 100 parts by weight of a typical metal working liquid and changes in the number of living fungi and odor are measured.

The typical metal working liquid has the following composition (in parts by weight):

| | |
|---|---|
| 10 machine oil | 50 |
| ethyleneoxide addition product of ricinoleic acid | 10 |
| chlorinated paraffin | 16 |
| water | 24 |

Evaluation Methods

The sample containing the bacteriostatic agent and the typical metal working liquid is placed in an incubator kept at 30° C. and the number of living fungi is counted with an organism counter (Sanai Biochecker TTC: total fungi number counter type) after 1, 2, 3, 6 and 10 days.

Odor is evaluated by the sense of smell of human being after 10 days.

In a comparative example, no bacteriostatic agent is added.

EXAMPLE 1

2 parts by weight of monoethanolamide of undecylenic acid is added to 100 parts by weight of the typical metal working liquid.

The results, shown in Table 1, reveal that the number of living fungi increases in time but is controlled to a value of $10^4$ after 10 days. No foul odor is observed after 10 days.

EXAMPLE 2

The procedure of Example 1 is repeated except that the bacteriostatic agent is a mixture of monoethanolamide of heptanoic acid/monoethanolamide of undecylenic acid (1:1). The results are shown in Table 1.

EXAMPLE 3

The procedure of Example 1 is repeated except that the bacteriostatic agent is an ethylene/oxide addition product of undecylenic acid (n=6). The results are shown in Table 1.

| | | living fungi/ml after | | | | | |
|---|---|---|---|---|---|---|---|
| EXAMPLES | ADDITIVE | 1 day | 2 days | 3 days | 6 days | 10 days | SMELL |
| 1 | $C_{11}$ monoethanolamide | $10^1$ | $10^2$ | $10^3$ | $10^4$ | $10^4$ | none |
| 2 | $C_7/C_{11}$ monoethanolamide (1:1) | $10^1$ | $10^1$ | $10^2$ | $10^2$ | $10^2$ | none |
| 3 | $C_{11}$ ethyleneoxide addition product(n = 6) | $10^1$ | $10^2$ | $10^2$ | $10^3$ | $10^3$ | none |
| Comp. | None | $10^2$ | $10^4$ | $10^7$ | $10^8$ | $10^8$ | stink |

The results of Examples 1, 2 and 3 reveal that compositions containing the bacteriostatic agent according to the present invention show improved bacteriostatic property comparing to the Comparative Example.

What is claimed is:

1. A metal working liquid comprising in metal working proportions machine oil, an ethylene oxide addition product of ricinoleic acid, chlorinated paraffin, water, and at least one bacteriostatic agent selected from the group consisting of:

(a) an amide of the formula:

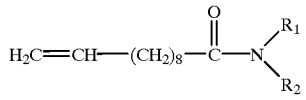

in which $R_1$ and $R_2$, identical or different, represent H, a $C_{1-20}$ alkyl group or a $C_{1-20}$ hydroxy-alkyl group, (b) an amine salt of the formula:

$$H_2C{=}CH{-}(CH_2)_8{-}COO^-R^+_3$$

in which $R_3$ represents a primary or secondary alkyl or an alkanol amine and (c) an alkylene oxide addition compound of the formula:

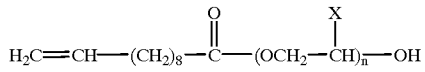

in which X represents H or a menthyl group and n represents an integer of 1 to 50.

2. A metal working liquid according to claim 1 comprising both C7 monoethanolamide and C11 monoethanolamide as species of (a).

3. A metal working liquid according to claim 1, comprising 0.01 to 40% by weight of at least one amide of undecylenic acid and/or at least one alkyleneoxide addition compound of undecylenic acid.

4. A metal working composition according to claim 1 comprising said amide.

5. A metal working composition according to claim 1 comprising said amine salt.

6. A metal working composition according to claim 1 comprising said alkylene oxide.

7. A metal working liquid according to claim 1, wherein said machine oil is present in a predominant proportion.

8. A metal working liquid according to claim 2, wherein said machine oil is present in a predominant proportion.

9. A metal working liquid according to claim 3, wherein said machine oil is present in a predominant proportion.

10. A metal working liquid according to claim 4, wherein said machine oil is present in a predominant proportion.

11. A metal working liquid according to claim 5, wherein said machine oil is present in a predominant proportion.

* * * * *